US005555988A

United States Patent [19]

Koch et al.

[11] Patent Number: 5,555,988

[45] Date of Patent: Sep. 17, 1996

[54] CLOSURE WITH TAMPER-INDICATING CAP FOR INJECTON AND INFUSION BOTTLES

[75] Inventors: Hermann Koch, Mainz; Hans-Joachim Loos, Ginsheim-Gustavsburg, both of Germany

[73] Assignee: Hoechst Aktiengesellschaft, Frankfurt am Main, Germany

[21] Appl. No.: 432,765

[22] Filed: May 2, 1995

[30] Foreign Application Priority Data

May 4, 1994 [DE] Germany ..... 44 15 679.0

[51] Int. Cl.[6] ..... B65D 51/20

[52] U.S. Cl. ..... 215/249; 215/251

[58] Field of Search ..... 215/247, 249, 215/251, 320

[56] References Cited

U.S. PATENT DOCUMENTS

| | | | |
|---|---|---|---|
| 3,193,128 | 7/1965 | Ravn | 215/249 X |
| 3,587,897 | 6/1971 | Rohde | 215/249 |
| 3,904,059 | 9/1975 | Bellamy, Jr. et al. | 215/251 X |
| 4,471,879 | 9/1984 | Connor et al. | 215/251 X |
| 5,080,245 | 1/1992 | Conard | 215/251 X |
| 5,335,801 | 8/1994 | Lee | 215/249 |

FOREIGN PATENT DOCUMENTS

| | | | |
|---|---|---|---|
| 724684 | 5/1969 | Belgium . | |
| 2146979 | 3/1973 | France . | |
| 2361350 | 5/1975 | Germany . | |
| 2820207 | 12/1978 | Germany | 215/247 |
| 7303249 | 9/1974 | Netherlands . | |
| 8400530 | 2/1984 | WIPO | 215/247 |

OTHER PUBLICATIONS

English language Abstract of NL–A–7303249.
English language Abstract of DE–B–2361350.
Search report for European Patent Appln. No. 95106007.8, dated Aug. 18, 1995.

*Primary Examiner*—Allan N. Shoap
*Assistant Examiner*—Nathan Newhouse
*Attorney, Agent, or Firm*—Finnegan, Henderson, Farabow, Garrett & Dunner, L.L.P.

[57] ABSTRACT

A closure with a tamper-indicating cap for injection and infusion bottles includes a holding part (3) for a seal (5), and a cap (1) with a downwardly extending edge (2) arranged between the holding part (3) and the seal (5). This arrangement prevents the seal from dropping into the bottle neck when the closure is pierced by a needle or cannula.

4 Claims, 2 Drawing Sheets

CLOSURE WITH TAMPER-INDICATING CAP FOR INJECTON AND INFUSION BOTTLES

BACKGROUND OF THE INVENTION

The invention relates to a closure with a tamper-indicating cap for injection and infusion bottles, comprising a holding part for a seal, the holding part having a recess in which the tamper-indicating cap is arranged in a positive-locking manner.

Closures of the type mentioned have the disadvantage that a seal, provided with a surface capable of sliding (e.g. coated with PTFE), is not held sufficiently firmly in the closure. During piercing with a spike of a transfusion (removal) device, it becomes deformed, slips out of its seat and drops into the bottle neck. In this context, the invention intends to provide a remedy.

SUMMARY OF THE INVENTION

The object is achieved by a closure of the type mentioned, wherein a cap with a hole and with the edge of the hole drawn in is arranged between the holding part and the seal, and the seal has a circumferential bead on which the cap with the hole is supported.

BRIEF DESCRIPTION OF THE DRAWINGS

The invention is explained in greater detail below with reference to drawings illustrating only one embodiment.

DETAILED DESCRIPTION OF THE PREFERRED EMBODIMENT

Figure 1:
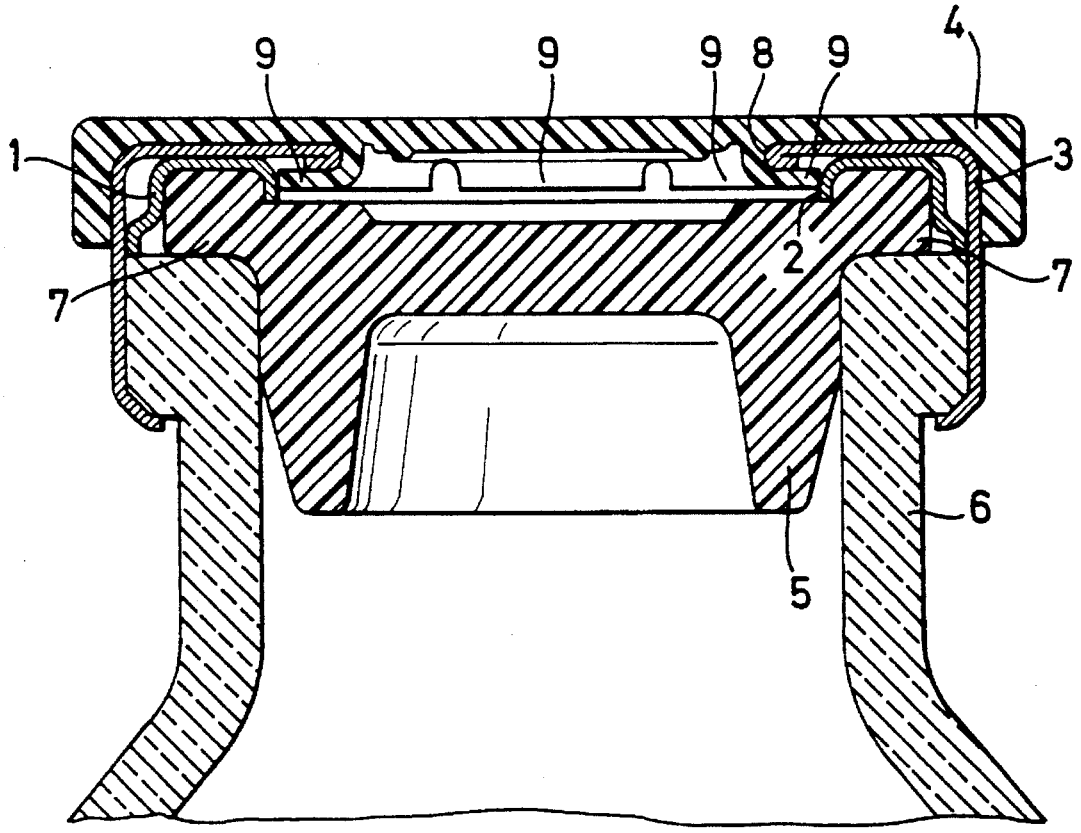
FIG. 1 shows the closure on a bottle neck in section.
Figure 2:
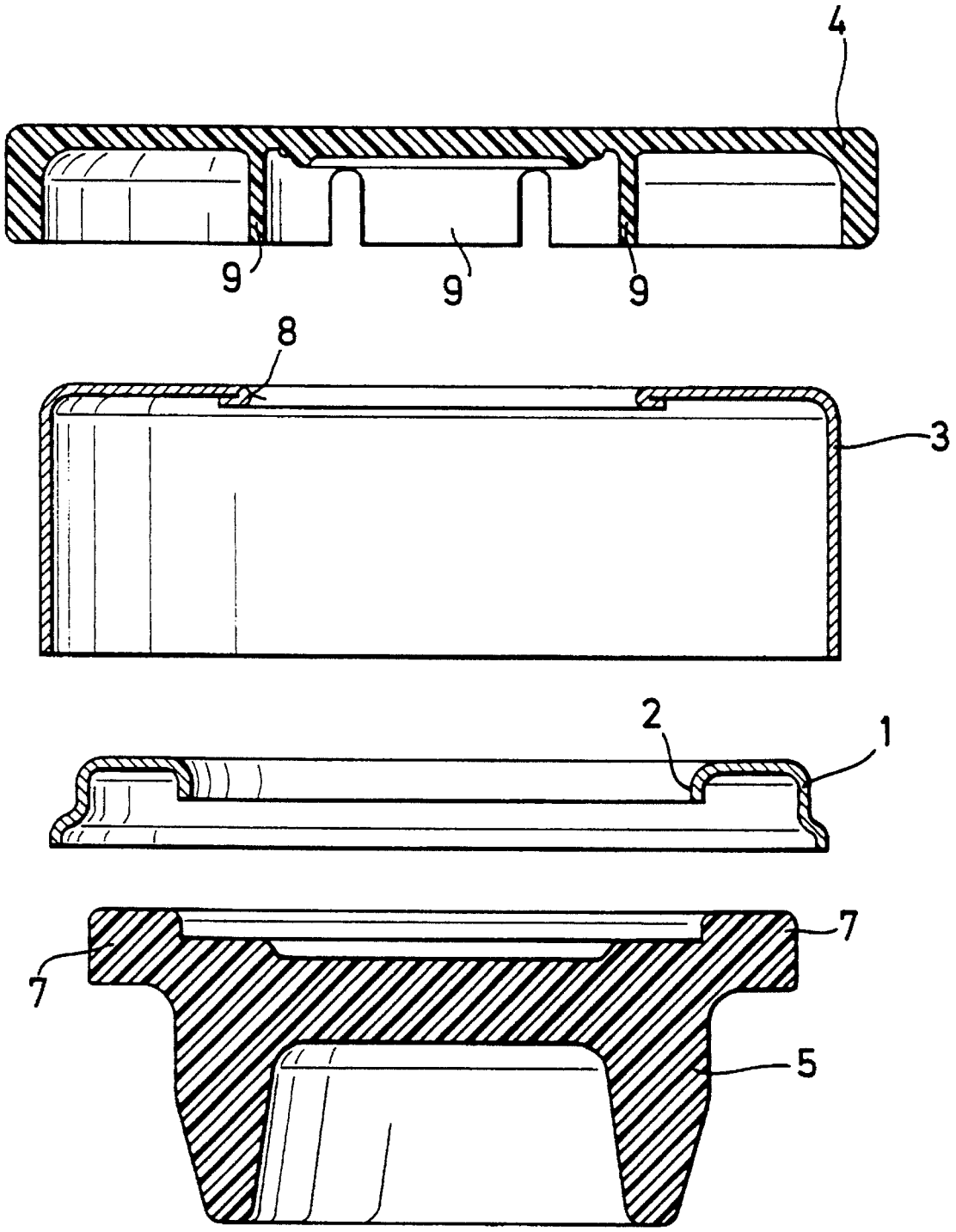
FIG. 2 shows the individual parts of the closure in section.

As shown in FIGS. 1 and 2, a closure has a holding part (3) for a seal (5), e.g. a stopper or a disk. The holding part (3) is provided with an edge (8) that defines a recess. Spreading segments (9) of the tamper-indicating cap (4) are inserted through the recess and are folded around the edge (8) when the closure is closed. A cap (1), including a downwardly extending edge (2) defining an opening is arranged between the holding part (3) and the seal (5). The seal (5) is provided with a circumferential flange (7) which is surrounded by and mates with the cap (1). As a result, the seal (5) is fixed in its position and can no longer yield into the bottle neck (6) under corresponding compression loading during piercing. The seal (5) can additionally or alternatively also be fixed by segments of the holding part (3) which are bent in the direction of the seal. The parts of the closure can all be made of the same material (metal or plastic) which is advantageous for any disposal problems occurring.

What is claimed is:

1. A closure for injection and infusion bottles, comprising:

a seal for enclosing an opening of a bottle, the seal including a circumferential flange for engaging a top edge of the bottle, the circumferential flange having a substantially vertical interior edge and a substantially vertical exterior edge opposite the interior edge; and a seal cap having a first downwardly extending edge engaging the interior edge of the flange and defining an opening and a second downwardly extending edge engaging at least a portion of the exterior edge of the seal flange, an end proximate the second edge supported by the top edge of the container and spaced from the seal flange, the seal cap surrounding and mating with the seal flange.

2. The closure of claim 1, further comprising a tamper-indicating cap positioned above the seal and seal cap.

3. The closure of claim 2, further comprising a holding part surrounding a portion of the seal cap and engaging an outer surface of the bottle, the holding part having an edge defining a recess, the edge engaging and holding the tamper-indicating cap.

4. The closure of claim 3, wherein the tamper-indicating cap includes spreading segments foldable around the edge of the holding part.

* * * * *